United States Patent [19]

Nielsen

[11] Patent Number: 4,536,818

[45] Date of Patent: Aug. 20, 1985

[54] SOLENOID DRIVER WITH SWITCHING DURING CURRENT DECAY FROM INITIAL PEAK CURRENT

[75] Inventor: Arnold D. Nielsen, Wayne, Mich.

[73] Assignee: Ford Motor Company, Dearborn, Mich.

[21] Appl. No.: 585,715

[22] Filed: Mar. 2, 1984

[51] Int. Cl.[3] ..... H01H 47/32

[52] U.S. Cl. ..... 361/154; 361/152

[58] Field of Search ..... 361/152, 154; 123/490

[56] References Cited

U.S. PATENT DOCUMENTS 3,581,156 5/1971 Dolbachian et al. .
4,180,026 12/1979 Schulzke et al. .
4,327,394 4/1982 Harper .
4,347,544 8/1982 Ohba .
4,360,855 11/1982 Ohba .

OTHER PUBLICATIONS

Publication by SGS-ATES Semiconductor Corporation in Jun. 1982, entitled, "Injector Driver Control—Tentative Data".

*Primary Examiner*—Reinhard J. Eisenzopf
*Attorney, Agent, or Firm*—Peter Abolins; Robert D. Sanborn

[57] ABSTRACT

A solenoid driver circuit has reduced power consumption by switching the solenoid coil current during a decay period from an initial peak current to a lower magnitude sustaining peak current. Current decays from the sustaining peak current magnitude for a predetermined length of time to a lower current level. Two transistors and a Zener diode are operatively connected to the solenoid and controlled by a logic circuit to apply the desired current to the solenoid. A sense resistor is coupled in series with the solenoid to sense current in the solenoid. The Zener diode is coupled in parallel with the sense resistor to provide a current decay path from the solenoid parallel to the sense resistor. The two transistors are turned on and off using logic flip-flops to sense voltage comparisons with the initial peak current voltage, the sustaining peak current, and the sustaining low current. A logic signal is generated as a function of the predetermined length of time, and an output signal is coupled to the bases of the two transistors to control their on/off states.

6 Claims, 16 Drawing Figures

DECAY PERIOD $I_P$
$I_{SUS\ PK}$
$T_1$
$T_1$
VERY SHORT (10-20μs) SHOWN EXPANDED $V(I_P)$
$V(I_{SUS\ PK})$
$V(I_{SUS\ LO})$
VOLTAGE ACROSS $R_{SENSE}$ $I_{PK}$
C $I_{SUS\ LO}$
A
E

F
INVERSE $I_{SUS\ LO}$ $I_{SUS\ PK}$
B
D
G
H

SOLENOID DRIVER WITH SWITCHING DURING CURRENT DECAY FROM INITIAL PEAK CURRENT

BACKGROUND OF THE INVENTION

1. Technical Field

This invention relates to controlling the flow of current to the coil of a solenoid.

2. Background Art

Various circuitry for driving solenoids is known. For example, it is known to apply a driving current to a solenoid in accordance with a periodic function, such as a square wave, thus energizing the solenoid with an average current less than the maximum applied current. It is also known that after a solenoid is energized and initial displacement has taken place, a reduced amount of power is necessary to maintain the solenoid in an energized condition. Thus, it is possible to reduce power consumption in a solenoid by initially applying a higher peak current magnitude and then reducing the current to a lower sustaining value. Such a current reduction can take place, for example, after a certain amount of time has passed. However, reliance upon the passage of a predetermined amount of time may be undesirable in that it may not accurately reflect the actual condition and current requirements of the solenoid. That is, current may be reduced before the solenoid is fully energized or current may be maintained at a high level an unnecessarily long period of time after the solenoid is energized.

Specific examples of circuitry for driving solenoids include U.S. Pat. No. 4,180,026 to Schulzke et al which teaches a pair of transistors to drive a solenoid. One of the transistors is turned on only between driving periods. Solenoid driving circuits with two transistors are also taught in patents to Ohba, U.S. Pat. Nos. 4,347,544 and 4,360,855. U.S. Pat. No. 3,581,156 to Dolbachian et al teaches an electromagnetic clutch driver having switches by which the clutch coil can be driven in a variety of modes. U.S. Pat. No. 4,327,394 to Harper teaches a relatively slow decay from a peak voltage to a sustaining voltage. Such a slow decay can be unacceptable for proper actuation of fuel injectors. The circuit taught by Harper is constrained from speeding up the decay by the time constant due to the inductance and resistance of the circuitry.

In particular, it is known to use a switching coil driver to control current to automotive fuel injector and transmission solenoids and to use switching (on-off) techniques to both minimize power dissipation and, in some cases, minimize solenoid non-linearity and hysteresis.

A solenoid driver may supply current to the coil as a current sinking or a current sourcing device. As a current sinking device, one side of the coil is connected to the battery. The solenoid is turned on by grounding (sinking) the other side of the coil through a switch such as a transistor. As a current sourcing device, one side of the coil is connected to ground. The solenoid is turned on by connecting the other side of the coil to battery voltage through a switch. This configuration has the advantage of protecting for an accidental short to ground in the wiring harness between the driver and the solenoid. If this happens the solenoid will turn off rather than on, as would happen with the current sinking configuration. Turning the solenoid off is a preferred failure mode since it is advantageous to have the primary failure mode (open electrical connection) the same as the secondary failure mode (short to ground). Both configurations have the advantage of only requiring one wire from the driver to the solenoid.

A publication by SGS-ATES Semiconductor Corporation in June 1982 entitled "Injector Driver Control—Tentative Data Sheet" discloses a current sinking device with a series transistor controlling flow through a solenoid coil and a sensing resistor. A second transistor selectively provides a current path parallel to the solenoid coil. The two transistors are controlled to reduce solenoid current from an initial peak current to reduced magnitude sustaining currents.

Even though reducing solenoid driving current from a peak current to a sustaining current is known, it is still desired to obtain a means to further reduce power dissipation and minimize nonlinearity in solenoid output in response to an input having a duty cycle. It would be desirable to avoid such limitations. These are some of the problems this invention overcomes.

DISCLOSURE OF THE INVENTION

A solenoid driver controls application of current to a solenoid and reduces total power dissipation. The solenoid driver circuit includes two transistors, a sense resistor, comparator means, a zener diode and logic means. A first transistor means is coupled in series with the solenoid. A second transistor means is coupled in parallel with the solenoid. A first sense resistor is coupled in series with the solenoid to sense current in the solenoid. A first comparator means is coupled to the sense resistor to determine the magnitude of the voltage drop across the sense resistor. A Zener diode is coupled in parallel with the sense resistor to provide a current decay path from the solenoid parallel to the sense resistor. The logic means is coupled to the first and second transistors for switching the first and second transistors on and off as a function of the voltage across the sense resistor so that an initial peak current is applied to the solenoid and the decay from the initial peak current to a sustaining low current is interrupted by periodic current increases.

Switching the coil current during the decay period from the initial peak current to a lower current during a sustaining period reduces power dissipation. After this decay period, additional switching is done by successively applying reduced magnitude sustaining peak currents with intermediate decay periods of predetermined length. The initial switching decay period also reduces a "flat" section in a graph of the transfer function of the solenoid relating an output parameter of the solenoid (e.g. pressure) and the duty cycle of the current applied to the solenoid. If it is desired to increase pressure with increasing duty cycle, then clearly such a flat spot is undesirable and it is advantageous to have it eliminated. For example, such switching can reduce the flat section in the hydraulic pressure vs. the duty cycle transfer function of transmission solenoids.

This flat spot is shown in prior art FIG. 7 on a graph of pressure vs. duty cycle of the solenoid current. FIG. 7 indicates that as the duty cycle increases in the intial decay period from peak to sustaining current the pressure remains constant. These are some of the problems this invention overcomes.

DETAILED DESCRIPTION OF THE INVENTION

Figure 2B:
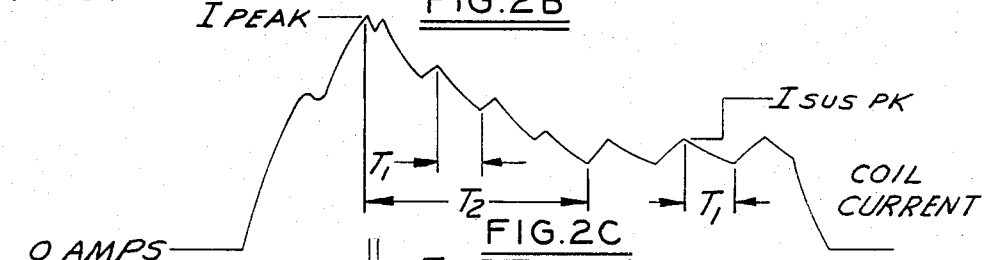
Figure 3:
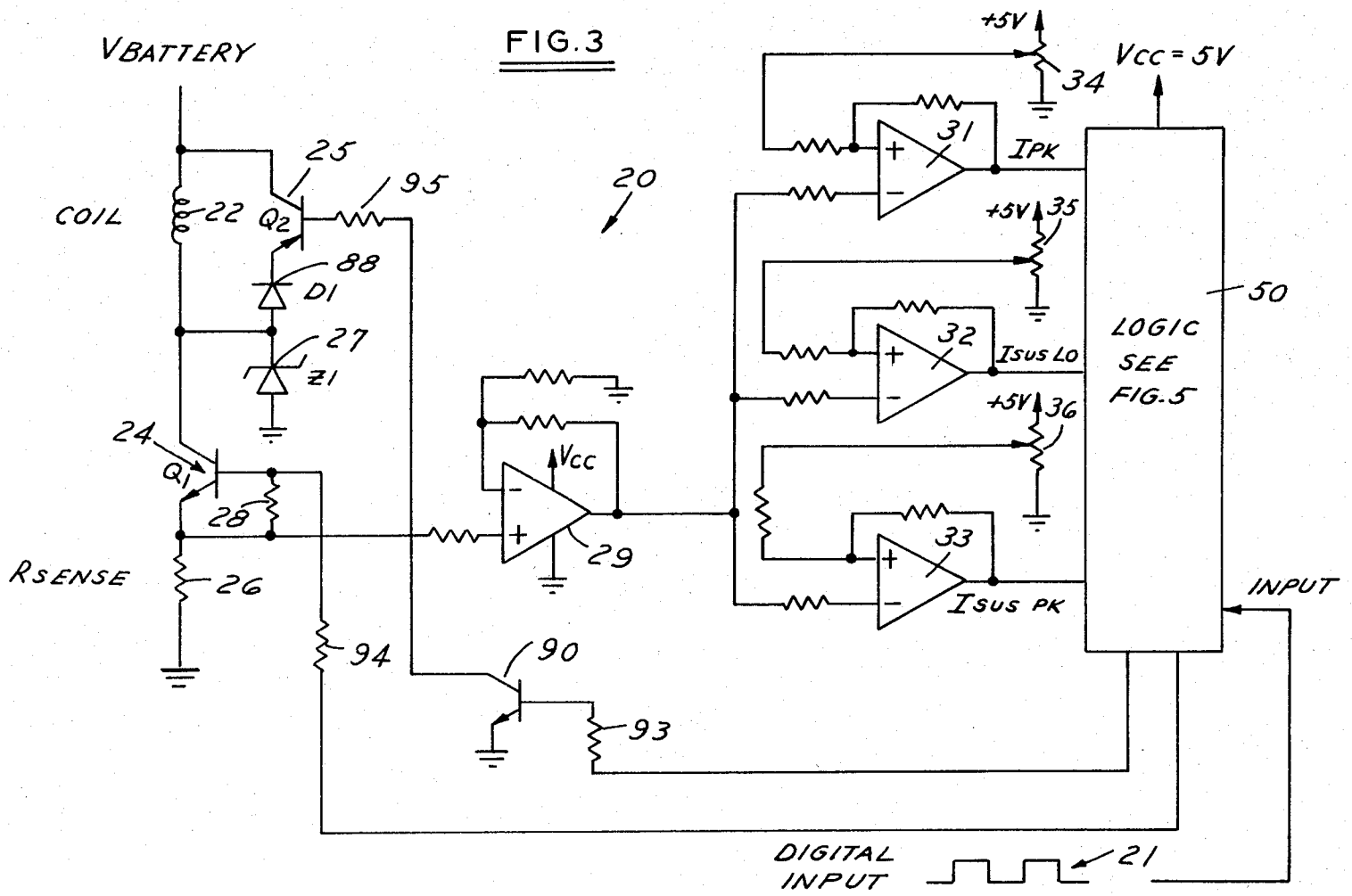
FIG. 3 is a schematic, partly block, diagram of a solenoid driver circuit coupled as a sinking driver and associated with the waveforms of FIG. 1.
Figure 4:
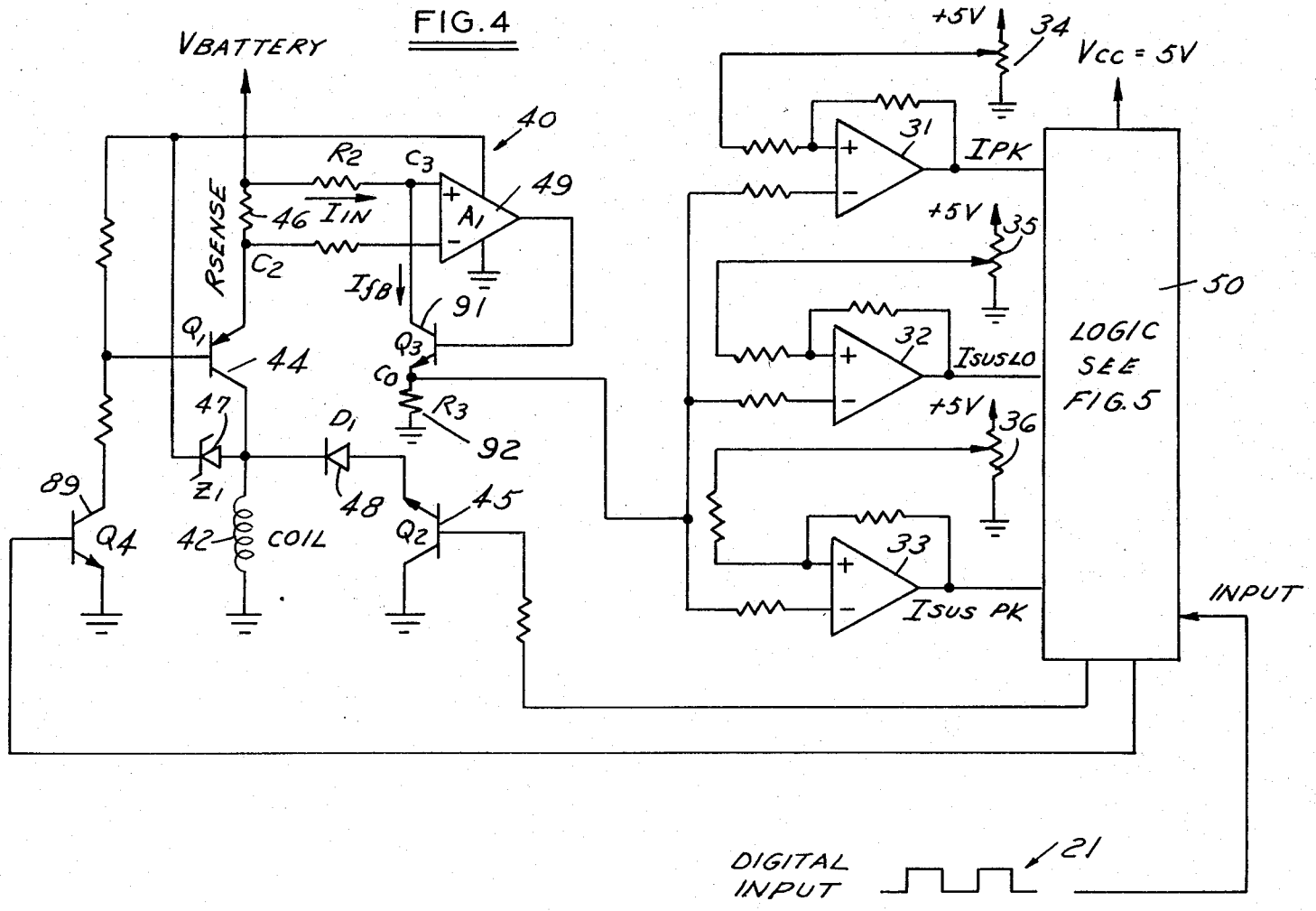
FIG. 4 is a schematic, partly block, diagram of a sourcing solenoid driver circuit connected between the solenoid coil and a battery potential, producing the waveforms associated with FIGS. 2A, 2B and 2C.

Solenoid driving circuits 20 of FIG. 3 and 40 of FIG. 4 each include a digital input 21 applied to a logic circuit 50. When digital input 21 goes to a logic high level, full battery voltage is applied to a coil (22, 42) until a specified initial peak current is reached. After this current level is reached, solenoid driver circuit 20, 40 operates to reduce coil current by a stepped decay during a time period $T_2$ (see FIGS. 1B and 2B) to the beginning of a sustaining switching period having a lower average current. The gradual decaying switching current is due to the combined effects of the coil current saturating, coil current hysteresis and the response time of a switching transistor. Subsequently, coil current is switched between a predetermined sustaining peak current and a lower current value, the current decay being a predetermined time period, using switching transistors until the digital input signal to logic circuitry 50 goes low and terminates. The sustaining peak current is a smaller magnitude than the initial peak current. Using a digital input signal pulse train of constant frequency but variable duty cycle, a desired average coil current can be achieved. Thus, a coil control parameter, such as fuel flow or hydraulic pressure in a transmission control, can be regulated via an input duty cycle applied to logic circuit 50.

Figure 1A:
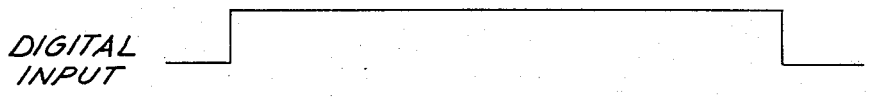
FIGS. 1A, 1B and 1C are three waveforms associated with a solenoid driving circuit coupled between the solenoid and the ground potential thereby selectively "sinking" or coupling the solenoid to ground, FIG. 1A being a digital logic signal with respect to time, FIG. 1B being a waveform representing a solenoid coil current with respect to time including switching during the first decay from a current peak, and FIG. 1C being a waveform representing solenoid coil voltage with respect to time.
Figure 1C:
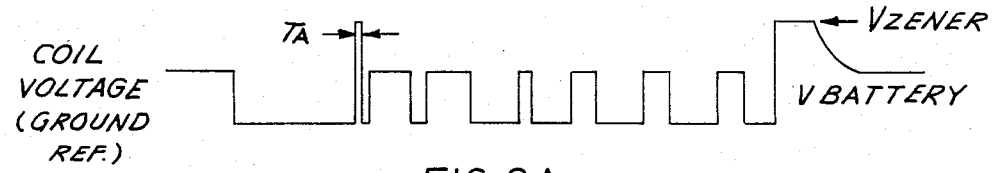
Figure 2A:
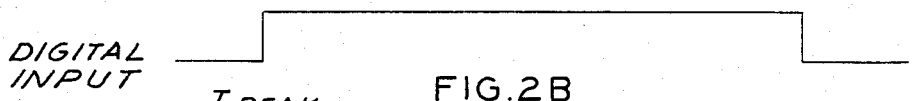
FIGS. 2A, 2B and 2C are a series of waveforms with respect to time similar to FIGS. 1A, 1B and 1C but associated with a sourcing driver coupled between the driven solenoid and a voltage source, FIG. 2A being a digital input to the solenoid driver circuit, FIG. 2B being the solenoid coil current with respect to time including switching during the initial decay, and FIG. 2C being the solenoid coil voltage with respect to time.

The following explanation generally applies to both sinking driver circuitry 20 of FIG. 3 and sourcing driver circuitry 40 of FIG. 4. The difference between a sinking and a sourcing driver circuit is in the method of sensing the current caused by the different configuration of the driving circuit with respect to the coil and battery. FIG. 2C, relating to sourcing drivers, is comparable to FIG. 1C, relating to sinking drivers, with inverted voltage polarities.

Referring to FIG. 3, sinking driver circuit 20 measures the current in coil 22 using sense resistor 26, one end of which is coupled to ground. The collector-emitter path of a transistor 24 is coupled in series with coil 22 and sense resistor 26 between a battery potential and a ground potential. A zener diode 27 is coupled between ground and the collector of transistor 24 thus providing a current path parallel to sense resistor 26. A non-inverting amplifier 29 has a positive input coupled to a node between sense resistor 26 and the emitter of transistor 24. When $Q_1$ transistor 24 is off (after reaching Ip) during the interval TA (see FIG. 1C) which commences when the voltage at the junction of coil 22 and zener diode 27 reaches the zener diode conducting voltage essentially no decay current flows through sense resistor 26. The voltage applied to the positive input of amplifier 29 is substantially zero.

Comparator 32 detects that current through sensing resistor 26 is less than the sustaining low current level and almost immediately turns on $Q_1$ transistor 24 and $Q_2$ transistor 25. Zener diode 27 turns off and coil current flows through sensing resistor 26. Comparator 33 detects that current through sensing resistor 26 is above the sustaining peak current level and turns off $Q_1$ transistor 24. After a predetermined decay time $T_1$, $Q_1$ transistor 24 is again turned on but the current is still above the sustaining peak current level and $Q_1$ transistor 24 is turned off. In summary, $Q_1$ transistor 24 is on and $Q_2$ transistor 25 is off until the initial peak current is reached. During the subsequent short decay, $Q_1$ transistor 24 is off and $Q_2$ transistor 25 remains off. At the end of the short decay, $Q_2$ transistor 25 turns on and remains on as long as the digital input remains high. After the end of the short decay, $Q_1$ transistor 24 switches between on and off states while coil current rises or decays, respectively.

The output of amplifier 29 is applied to the negative inputs of a comparator 31 for establishing an initial peak current level, a comparator 32 for establishing a sustaining low current level and a comparator 33 for establishing a sustaining peak current level. The sustaining low current level is set lower than the sustaining peak current for proper operation. To this end, comparator 31 has a positive input coupled to a variable resistor 34 for providing a reference voltage at the positive input of comparator 31. The positive input is related to the initial peak current value and thus determines the occurrence of an output from comparator 31. Similarly, the positive input from comparator 32 is coupled to a resistor 35 and the positive input to comparator 33 is coupled to a resistor 36. Logic circuit 50 processes input information and applies an output to transistor 25 through a resistor 95, a transistor 90 and a resistor 93 and an output to transistor 24 through a resistor 94. Transistor 25 has an emitter-collector path coupled in parallel with coil 22 and provides a low resistance to reduce the speed of current decay in coil 22 after the sustaining peak current is first reached.

When a digital input 21 applied to logic circuit 50 goes to a logic high state, transistor 24 turns on and transistor 25 is off. Subsequently, when the predetermined initial peak current level through coil 22 is reached, transistor 24 turns off and a decay current flows through zener diode 27. After the initial peak current level is reached, no current flows through sensing resistor 26. Comparator 32 compares a detected voltage to that which would be present when a sustaining low current is flowing and thinks that the sustaining low current has been achieved. As described later in greater detail, logic circuit 50 turns on $Q_1$ transistor 24 and $Q_2$ transistor 25. Comparator 33 almost immediately detects that current in coil 22 is above its set point of a sustaining peak current magnitude and turns $Q_1$ transistor 24 off. After a time $T_1$ (FIG. 1B), $Q_1$ transistor 24 is again turned on. The current in coil 22 is still above the sustaining peak current magnitude as detected by comparator 33. This causes logic circuit 50 to almost immediately turn off $Q_1$ transistor 24. There results a cyclical rising and falling of coil current superimposed on a gradual decaying of the coil current due to the combined effects of the response time of $Q_1$ transistor 24 and the hysteresis and saturation characteristics of coil 22.

Figure 1B:
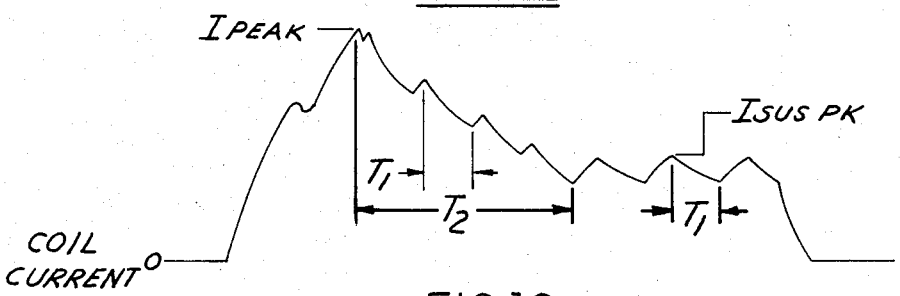
Figure 2C:
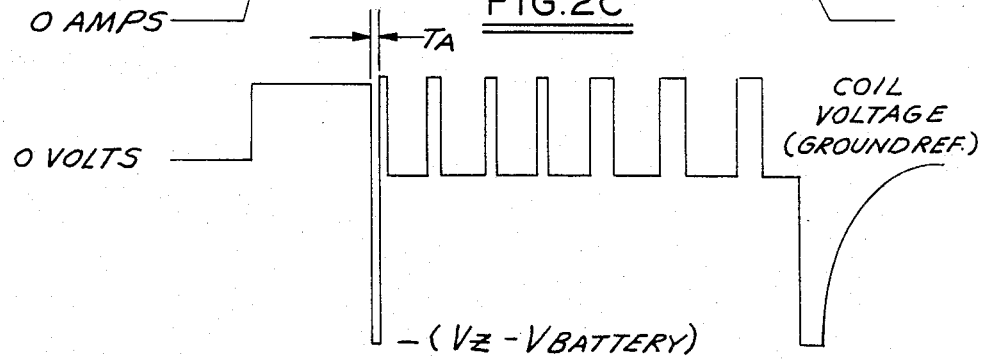

During the sustaining period, after the termination of time period $T_2$ in FIGS. 1B, 2B, current is applied to coil 22 which increases to a specified predetermined sustaining peak current, causing $Q_1$ transistor 24 to turn off for a specified time interval $T_1$ (FIG. 1B). Since $Q_2$ transistor 25 is on during this time, the coil decay time constant is increased because of a low resistance path inserted in parallel with coil 22 by the on condition of transistor 25. As is known, the time constant for discharging an inductive resistive circuit is inversely proportional to the resistance. A diode 88 coupled between the emitter of transistor 25 and coil 22 allows current flow through transistor 25 only during this decay period. A reduced current level is reached after time interval $T_1$ elapses. Then transistor 24 is again turned on until the sustaining peak current is again achieved at which point transistor 24 turns off for a time $T_1$. This sequence continues until the digital input 21 goes to a logic zero and indicates the termination of the desired energization of coil 22.

Thus, during the sustaining period, initiated by the coil decay current falling below the sustaining peak current level the first time and terminated by the end of the logic 1 on digital input 21, transistor 24 is on during increasing coil current and off during decaying coil current and transistor 25 is constantly on. As a result, subsequent decays from the sustaining peak current magnitude to a lower value of sustaining current are more gradual. This results in a reduced power dissipation compared to operating in a linear mode wherein a constant driving current would be applied to the solenoid coil. Also, since transistor 25 is on during the sustaining period, the frequency of the sustaining current and its duty cycle also contribute to reduced power dissipation.

Referring to sourcing driver circuit 40 of FIG. 4, the reference for the current sensing circuitry is the battery voltage, and not ground. A differential amplifer 49 senses the voltage across sense resistor 46 using a positive input on one side of a sense resistor 46 and a negative input on the other side of sense resistor 46. Operation of circuit 40 is similar to the operation of circuit 20. Transistor 44 is in series with coil 42 and controls the application of driving current to coil 42. Transistor 45 provides a low resistance path in parallel with coil 42 during the sustaining period (FIG. 3C). Diode 48 permits only a decay current, and not a driving current, through transistor 45. Zener diode 47 provides a decay current path for coil 42 in parallel with sensing resistor 46. Transistor 44 is actuated through a transistor 89 from logic circuit 50. The voltage across sense resistor 46 is applied to comparators 31, 32 and 33 through an amplifier 49, a transistor 91 and a resistor 92. As before, voltages from resistors 34, 35 and 36 are applied to comparators 31, 32, and 33, respectively to generate signals to be applied to logic circuit 50 which, in turn, generates outputs to be applied to transistors 44 and 45.

Figure 5:
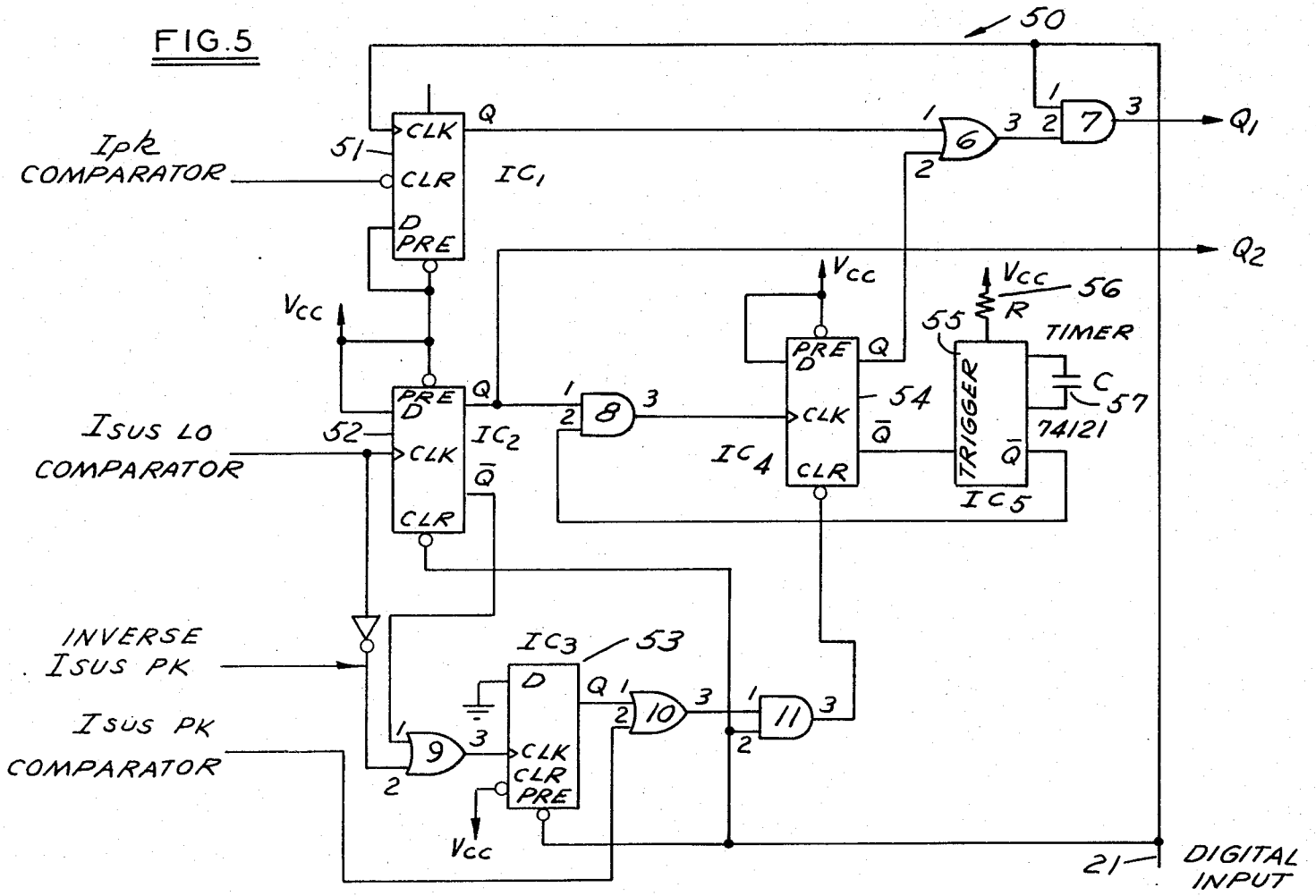
FIG. 5 is a logic schematic, partly block, diagram of a logic circuit associated with both FIGS. 3 and 4.

Referring to FIG. 5, logic circuit 50 is common to both sourcing driver circuit 40 and sinking driver circuit 20. The outputs from comparators 31, 32 and 33 are applied to inputs 51, 52 and 53, respectively, of logic circuit 50. A digital input at 21 causes cycling of the output supplied to transistors 24, and 25 of circuit 20 and transistors 44 and 45 of circuit 40. The operation of logic circuit 50 is explained below with respect to both FIG. 5 and FIGS. 6A through 6F.

Figure 7:
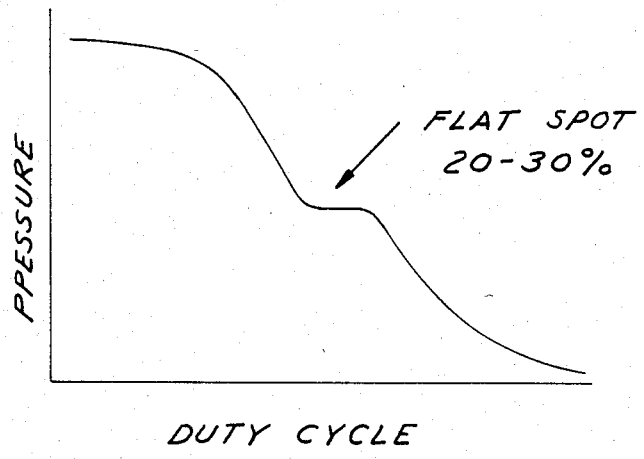
FIG.7 PRIOR ART
FIG. 7 is a graphic representation of pressure vs. duty cycle including a flat spot in accordance with the prior art.

In accordance with an embodiment of this invention the flat section shown in the graph of prior art FIG. 7 can be reduced. The position of the trailing edge of a digital input controlling activation of the solenoid (see e.g. FIGS. 1A and 2A) is a function of the duty cycle. As the trailing edge moves forward toward the leading edge, there is decreased activation of the solenoid which results in decreased pressure. When the input digital signal duration decreases to a point where the falling edge falls within the TA interval of FIGS. 1C and 2C, the combination of the digital input does not have an affect on the flow current. This is because the coil current is already decaying and can neither decay faster nor cease to decay until the end of the TA interval. This means that there is no change in the coil output parameter such as hydraulic pressure as the duty cycle changes in the TA interval period. This problem is overcome by minimizing the width of the TA interval.

LOGIC CIRCUIT OPERATION

Figure 6A:
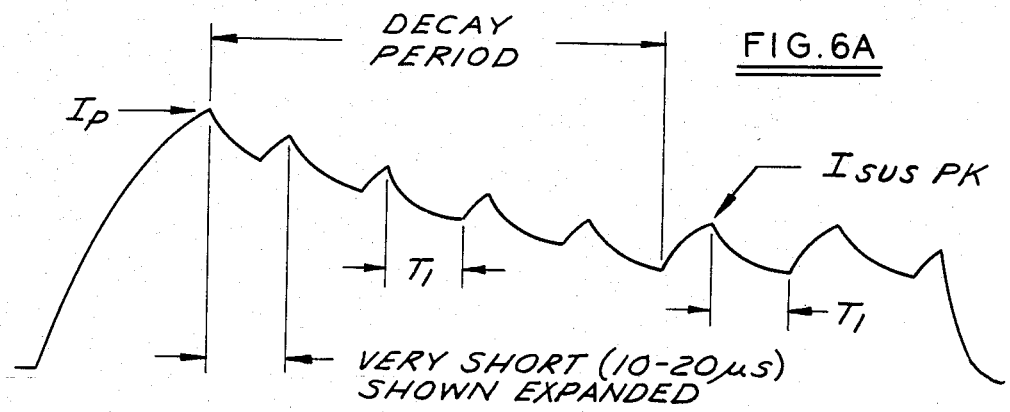
FIGS. 6A, 6B, 6C, 6D, 6E and 6F are waveforms with respect to time associated with FIG. 5 and include, coil current, voltage across the sense resistor, the peak current comparator output, sustaining low current comparator output, inverse sustaining low current comparator output and sustaining peak current comparator output, respectively.
Figure 6B:
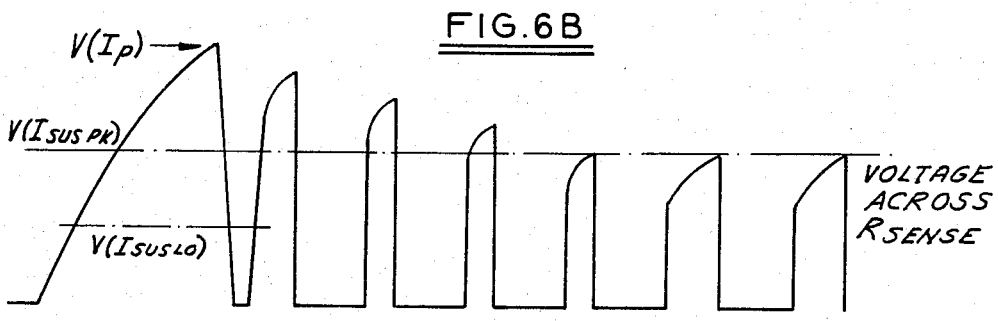
Figure 6C:
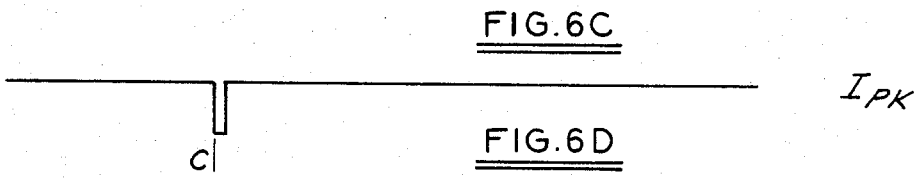
Figure 6D:
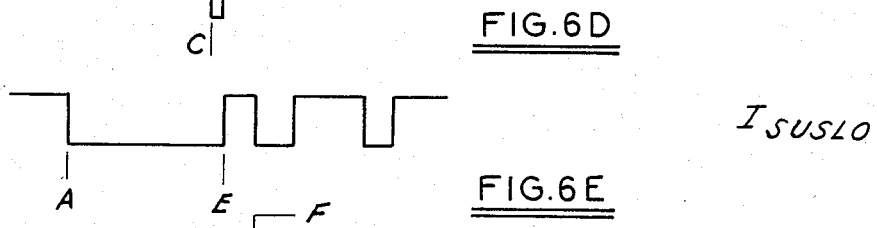
Figure 6E:
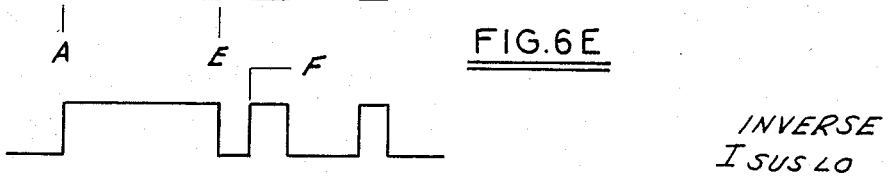
Figure 6F:
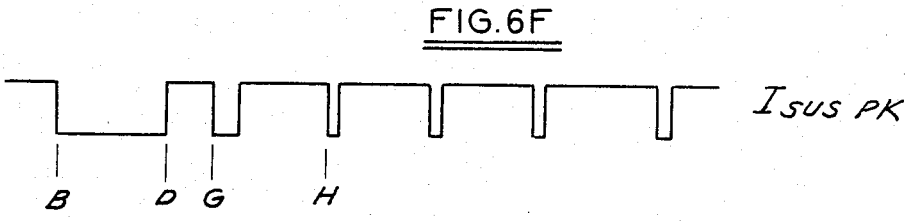

The inputs provided by initial peak current comparator 31, sustaining low current comparator 32, and sustaining peak current comparator 33 are shown in FIGS. 6C, 6D and 6F, respectively. In FIG. 5, integrated circuits 51, 52, 53 and 54 are D-type flip-flops such as a commercially available No. 7474. Integrated circuit inputs include a clock input, a clear input, a D-input and a preset input. Outputs include a Q and an inverse of Q. When a clear input goes to a logic zero, output Q goes to a logic zero and the inverse of output Q goes to a logic one. When a logic zero is applied to the preset input, the output Q goes to a logic one and the Q inverse output goes to a logic zero. When there is a rising positive edge of a pulse applied to the clock input, the logic input level appearing at the D input is applied to the Q output and its inverse is applied to the inverse Q output.

A digital input of a logic zero is applied to input 1 of an AND gate 7. Gate 7 has an output of zero when one of its inputs is zero. The output of gate 7 is applied to transistor $Q_1$ (transistor 24 in circuit 20 and transistor 44 in circuit 40) which is turned off. When a digital input of a logic zero is applied to the clear input of integrated circuit 52, the output Q is set equal to a logic zero and applied to transistor $Q_2$ (transistor 25 in circuit 20 and transistor 45 in circuit 40) which is also turned off. Applying a logic zero digital input to the preset input of integrated circuit 53 sets the Q output of integrated circuit 53 to a logic one. When a logic zero digital input is applied to the second input of an AND gate 11, the output of AND gate 11 is applied to the clear input of integrated circuit 54 which sets the Q output of integrated circuit 54 equal to a logic zero.

When digital input 21 goes to logic one state, integrated circuit 51 sets the Q output of integrated circuit 51 equal to a logic one. Since a logic one is applied to an input 1 of an OR gate 6, the output 3 of OR gate 6 is equal to a logic one. AND gate 7 has both inputs 1 and 2 at a logic one level, one input being coupled to the digital input and the other to the output of OR gate 6 so that it has an output at pin 3 of a logic one level. This is applied to transistor $Q_1$ which is turned on. Transistor $Q_2$ is still off since integrated circuit 52 needs a zero to one transition of the sustaining low current applied to the clock input to change the state of the output of integrated circuit 52.

When the sustaining low current comparator drops from a high to a low logic level as indicated in FIG. 6D at point A, the output of integrated circuit 52 remains the same. Also, the input to integrated circuit 53 at the clock input remains the same because the output of OR gate 9 is not changed.

When the sustaining peak current comparator drops from a logic one to a logic zero level at point B of FIG. 6F, there is no change in the output of OR gate 10, to which the peak sustaining current is applied because the other input to OR gate 10 remains at a logic one.

When the peak current comparator goes from a logic one to a logic zero at point C indicated on FIG. 6C, integrated circuit 51 is cleared so that output Q is set equal to a logic zero. Further, OR gate 6 now has both input pins 1 and 2 equal to a logic zero so that the output of OR gate 6 is equal to a logic zero. This, in turn, affects the output of AND gate 7 which receives the output of OR gate 6. Transistor $Q_1$ turns off because of the logic zero applied by AND gate 7 to transistor $Q_1$. When transistor $Q_1$ turns off, the coil current starts decaying. The peak current comparator will have no further effect until the next zero to one transition of the digital input.

When the sustaining peak current comparator goes from a logic zero to a logic one, as indicated at point D, FIG. 6F, nothing changes since OR gate 10 still has a signal indicating a logic one applied to an input 1. Thus, output pin 3 of OR gate 10 still remains at a logic one.

When the sustaining low current goes from a logic zero to a logic one as indicated at point E in FIG. 6D, integrated circuit 52 toggles so that the output Q is equal to a logic one. Circuit 52 remains that way until cleared by digital input 21. With output Q of integrated circuit 52 equal to a logic one, transistor $Q_2$ turns on. The output from pin 3 of AND gate 8 applied to the clock input of integrated circuit 54 toggles integrated circuit 54 so that output Q is equal to a logic one.

Integrated circuit 55 is typically a 74121 and has a timing function. The timing function of integrated circuit 55 is not triggered at this time (just after point E) since triggering requires a logic zero to one transition applied to the triggering input. The output of OR gate 6 is equal to a logic one because a logic one is applied to an input 2 from the output of integrated circuit 54. Also, the output of AND gate 7 is a logic one because both inputs are a logic one and this turns on transistor $Q_1$.

When the inverse of the sustaining low current comparator goes through a logic zero to a logic one transition as indicated at point F in FIG. 6E, integrated circuit 53 toggles since OR gate 9 has a logic zero input at pin 1. Thus, the output of OR gate 9 makes a zero to one transition due to the output of the sustaining low current comparator. This allows the sustaining peak current comparator to clear integrated circuit 54.

The purpose of integrated circuit 53 and gates 9, 10 and 11 is to prevent the sustaining peak current comparator from prematurely clearing integrated circuit 54 until after the sustaining low current comparator sets integrated circuit 53. This sometimes occurs in actual solenoid applications due to the fact that all the comparators need a considerable amount of hysteresis for noise immunity. In addition, the time interval from point E to point G can become quite small, e.g. 10 microseconds. If premature clearing of integrated circuit 54 were to occur, transistor $Q_1$ would turn off until the next digital input having a logic zero to one transition.

When the sustaining peak current has a transition from a logic one to a logic zero as indicated at point G at FIG. 6F, since pin 1 of OR gate 10 is a logic zero, the output of AND gate 11 becomes logic zero and, in turn, clears integrated circuit 54. When integrated circuit 54 clears the output, Q is a logic zero. The output of OR gate 6 goes to a logic zero. With the output of OR gate 6 equal to zero, this turns the output of AND gate 7 also equal to zero which turns off transistor $Q_1$.

During the time interval $T_1$ as indicated in FIG. 6A, from the sustaining peak current to a sustaining lower current, integrated circuit 55 is triggered by a transition of integrated circuit 54 from zero to one at the inverse Q output. After time interval $T_1$ has passed, as determined by resistor 56 and capacitor 57 coupled to integrated circuit 55, integrated circuit 54 is toggled through AND gate 8. This again turns on transistor $Q_1$.

When the sustaining peak current comparator goes from a logic high to a logic low level as indicated at point H of FIG. 6F, integrated circuit 54 is again cleared. This turns off transistor $Q_1$. Integrated circuit 55 is triggered by the inverse Q output of integrated circuit 54. After a time, $T_1$ is passed, integrated circuit 54 is toggled by gate 8. This again turns on transistor $Q_1$. This recited cycle during the sustaining continues until the digital input is again equal to zero.

Following are test results using a switching driver in accordance with an embodiment of this invention in comparison with a linear driver on transmission solenoids. The power dissipation of such a switching driver is substantially less than the power dissipation of a linear driver.

| | TOTAL POWER DISSIPATION OF DRIVER TRANSISTOR(S) - WATTS | |
|---|---|---|
| LOAD | LINEAR DRIVER | SWITCHING DRIVER |
| Transmission solenoid R = 1.5 ohms L = 4 mh | 12 | 2 |

Various modifications and variations will no doubt occur to those skilled in the various arts to which this invention pertains. For example, the circuit components coupled to the logic circuit may be varied from that described herein. These and all other variations which basically rely on the teachings through which this disclosure has advanced the art are properly considered within the scope of this invention as defined by the appended claims.

I claim:

1. A solenoid driver circuit for controlling application of current to a solenoid and reducing total power dissipation, said solenoid driver circuit including:

a first transistor means for completing one series current path through the solenoid;

a second transistor means coupled in series with said first transistor means for providing a current path parallel to the solenoid;

a sense resistor coupled in series with said first transistor means for sensing current in the solenoid;

a Zener diode coupled in parallel with the series combination of said first transistor means and said sense resistor to provide a current path from the solenoid parallel to said sense resistor;

a first comparator means coupled to said sense resistor to compare the sensed current in said sense resistor to a first control current representative of a desired initial peak current in the solenoid;

a second comparator means coupled to said sense resistor to compare the sensed current in said sense resistor to a second control current representative of a desired low sustaining current in the solenoid;

a third comparator means coupled to said sense resistor to compare the sensed current in said sense resistor to a third control current representative of a desired sustaining peak current in the solenoid, said sustaining peak current being larger in magnitude than said low sustaining current and smaller in magnitude than said initial peak current; and logic means coupled to said first, second and third comparator means so as to receive input signals which are a function of the sense resistor current and the first, second and third control currents, for switching said first and second transistor means on and off as a function of the output of said first, second and third comparator means so that said initial peak current is applied to the solenoid and the current decay from the initial peak current to said sustaining peak current is interrupted by periodic current increases so as to produce an oscillatory function with a decaying average value, said second transistor switching from off to on at the end of an initial solenoid current decay from said initial peak current and said first transistor being off when solenoid current is decaying and on when solenoid current is rising.

2. A solenoid driver circuit as recited in claim 1 wherein:

said first transistor means has an emitter-collector path coupled in series with said sense resistor for completing one series current path through the solenoid;

a first diode is coupled in the emitter-collector path of said second transistor means and the combination of said first diode and said second transistor means is coupled in series with said emitter-collector path of said first transistor means so that the combination of said second transistor means and said first diode provides a parallel discharge path for the solenoid while preventing a solenoid driving current from passing through said second transistor means; and said logic means being adapted, as a function of current in the sense resistor, to turn on said first transistor means until the sense resistor current reaches the initial peak current, turn off said first transistor means on reaching the initial peak current in the sense resistor, turn on said first and second transistor means when the current in said sense resistor has decayed to a predetermined low sustaining current level and maintain said second transistor in an on-state while switching said first transistor between on and off states to vary solenoid current in an oscillatory decaying manner until solenoid current decays to the peak sustaining current level so that a sustaining period is reached when solenoid current varies between the peak sustaining current level and a lower current level using a predetermined time period for decay from the peak sustaining current level.

3. A solenoid driver circuit as recited in claim 2 wherein said sense resistor is coupled between said first transistor means and a ground potential and an input to said first, second and third comparators is coupled to a node between said sense resistor and said first transistor means.

4. A solenoid driver circuit as recited in claim 2 wherein said sense resistor is coupled between said first transistor means and a source voltage potential and an input to said first, second and third comparators is coupled to detect a voltage across said sense resistor.

5. A solenoid driver circuit as recited in claim 3 wherein said first, second and third comparators are coupled to said sense resistor through a first amplification means.

6. A solenoid driver circuit as recited in claim 4 wherein said first, second and third comparators are coupled to said sense resistor through a differential amplifier coupled to the voltage across said sense resistor, a control transistor and a current detecting resistor.

* * * * *